United States Patent [19]

Merrell

[11] Patent Number: 4,815,773

[45] Date of Patent: Mar. 28, 1989

[54] DOOR LOCK ASSEMBLY FOR FREIGHT VEHICLES

[76] Inventor: Richard L. Merrell, 1310 Isabella, Wilmette, Ill. 60091

[21] Appl. No.: 15,043

[22] Filed: Feb. 17, 1987

[51] Int. Cl.[4] ..... E05C 5/02

[52] U.S. Cl. ..... 292/60; 292/144; 292/150; 292/341.16; 292/DIG. 32; 105/310.1

[58] Field of Search ..... 292/150, 175, 144, 163, 292/57, 60, 169.14, 169.15, 341.16, 341.15, DIG. 32, 4; 70/128; 105/310.1, 308.1, 309

[56] References Cited

U.S. PATENT DOCUMENTS

| | | | |
|---|---|---|---|
| 400,077 | 3/1889 | Haisn | 292/60 |
| 449,916 | 4/1891 | Raisor | 292/60 |
| 479,152 | 7/1892 | McClellan | 292/60 |
| 787,038 | 4/1905 | Hahn | 292/DIG. 32 |
| 848,256 | 3/1907 | Maaskant | 292/341.16 |
| 925,433 | 6/1909 | Gilroy . | |
| 932,658 | 8/1909 | Wadsworth . | |
| 991,610 | 5/1911 | Gilroy . | |
| 1,050,556 | 1/1913 | McGill | 292/144 |
| 1,065,788 | 6/1913 | Driscoll . | |
| 1,249,168 | 12/1917 | Milner . | |
| 1,299,726 | 4/1919 | Hobson et al. . | |
| 1,364,970 | 1/1921 | Wood | 292/4 |
| 1,409,210 | 3/1922 | Zebich . | |
| 1,602,264 | 10/1926 | Hutchison | 292/60 |
| 1,647,225 | 11/1927 | Hicks . | |
| 1,647,227 | 11/1927 | Hicks . | |
| 1,647,228 | 11/1927 | Hicks . | |
| 1,665,952 | 4/1928 | Feeney et al. . | |
| 1,684,980 | 9/1928 | Ward et al. . | |
| 1,696,045 | 12/1928 | Lach | 70/128 |
| 1,776,559 | 9/1930 | Hobbs . | |
| 1,917,159 | 7/1933 | Schaaf | 292/169.14 |
| 1,942,219 | 1/1934 | Segal | 292/57 |
| 2,466,855 | 4/1949 | Lauver . | |
| 2,758,861 | 8/1956 | Molloy | 292/57 |
| 3,298,728 | 1/1967 | Dye | 292/4 |
| 3,614,147 | 10/1971 | Spector . | |
| 3,624,761 | 11/1971 | Kohn . | |
| 3,843,174 | 10/1974 | Bogunovich et al. | 292/144 |
| 3,877,394 | 4/1975 | Schmeling . | |
| 3,917,328 | 11/1975 | De Filippi | 292/DIG. 32 |
| 3,919,869 | 11/1975 | Fromm | 292/341.16 |
| 3,953,062 | 4/1976 | Maston | 70/128 |
| 4,012,063 | 3/1977 | Sherlock et al. | 292/341.16 |
| 4,021,066 | 5/1977 | McShane | 292/DIG. 32 |
| 4,655,487 | 4/1987 | Korn et al. | 70/128 |

FOREIGN PATENT DOCUMENTS

| | | | |
|---|---|---|---|
| 2717471 | 11/1978 | Fed. Rep. of Germany | 292/DIG. 32 |
| 266960 | 1/1927 | Italy | 292/60 |

*Primary Examiner*—Gary L. Smith
*Assistant Examiner*—Eric K. Nicholson
*Attorney, Agent, or Firm*—Trexler, Bushnell, Giangiorgi & Blackstone, Ltd.

[57] ABSTRACT

A door-locking assembly for securing the door of freight transporting compartment includes a bolt which is movable between a first, door-locking position and a second, door-unlocking position, and is additionally movable into a third, door-unlocking position which provides additional restraint against motion of the bolt into the first or second positions. The assembly also includes catch means for selectively and alternatively either blocking or clearing the movement of the bolt between the first and second positions and between the first and third positions.

22 Claims, 2 Drawing Sheets

DOOR LOCK ASSEMBLY FOR FREIGHT VEHICLES

BACKGROUND OF THE INVENTION

This invention relates to apparatus for locking the door of a freight transporting compartment or the like, and particularly relates to door-locking apparatus which can be controlled by pneumatic pressure derived from the typical air brake system of the transporting vehicle.

In the effort to improve theft-resistant locks, door locking devices for freight transporting compartments have been developed which are controlled and operated by pneumatic pressure derived from either an auxiliary system or from a branch line communicating with the air brake system typically installed on railroad cars and truck trailers as described, for example, in U.S. Pat. Nos. 3,614,147; 3,624,761; and 3,843,174. The last-mentioned patent describes an anti-theft door-locking apparatus in which the locking pin is selectively movable between an active position in which the door is locked and an inactive position allowing the door to be opened; the apparatus also includes an operation-inhibiting means in the form of an abutment component or a detent and recess arrangement to hold the locking pin in its inactive position in order to prevent inadvertent or unauthorized return movement of the locking pin into the active position.

SUMMARY OF THE INVENTION

In accordance with this invention a door-locking assembly for securing the door of a freight transporting compartment includes a bolt member which is movable between a first, door-locking position and a second, door-unlocking position, and is additionally movable into a third, door-unlocking position which provides additional restraint against motion of the bolt into the first or second positions. The assembly also includes catch means for selectively and alternatively either blocking or clearing the movement of the bolt member between the first and second positions and between the first and third positions.

DETAILED DESCRIPTION OF THE ILLUSTRATED EMBODIMENT

Figure 1:
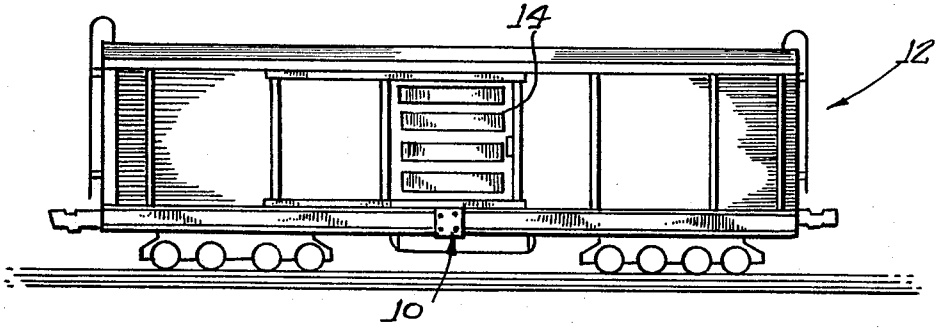
FIG. 1 is a side elevation view of a railroad boxcar on which an embodiment of the door lock assembly of the invention is installed.
Figure 2:
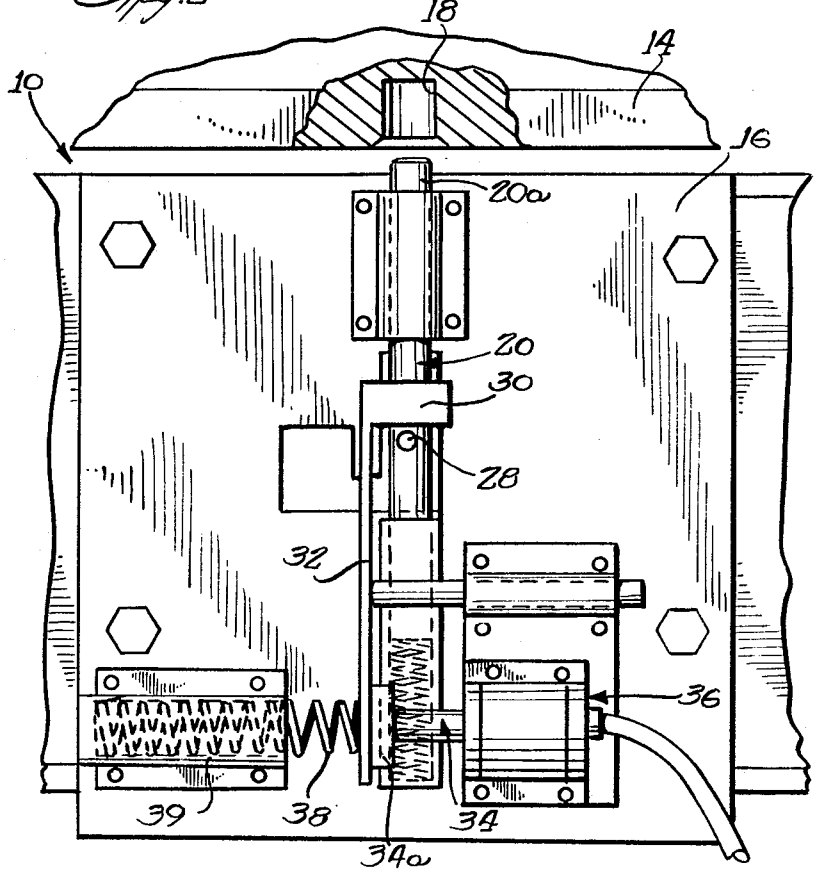
FIG. 2 is the unexposed, back side elevation view of the door lock assembly from under the boxcar of FIG. 1 illustrating the lowered, unlocked position of the locking bolt of the assembly in relation to the boxcar door.
Figure 3:
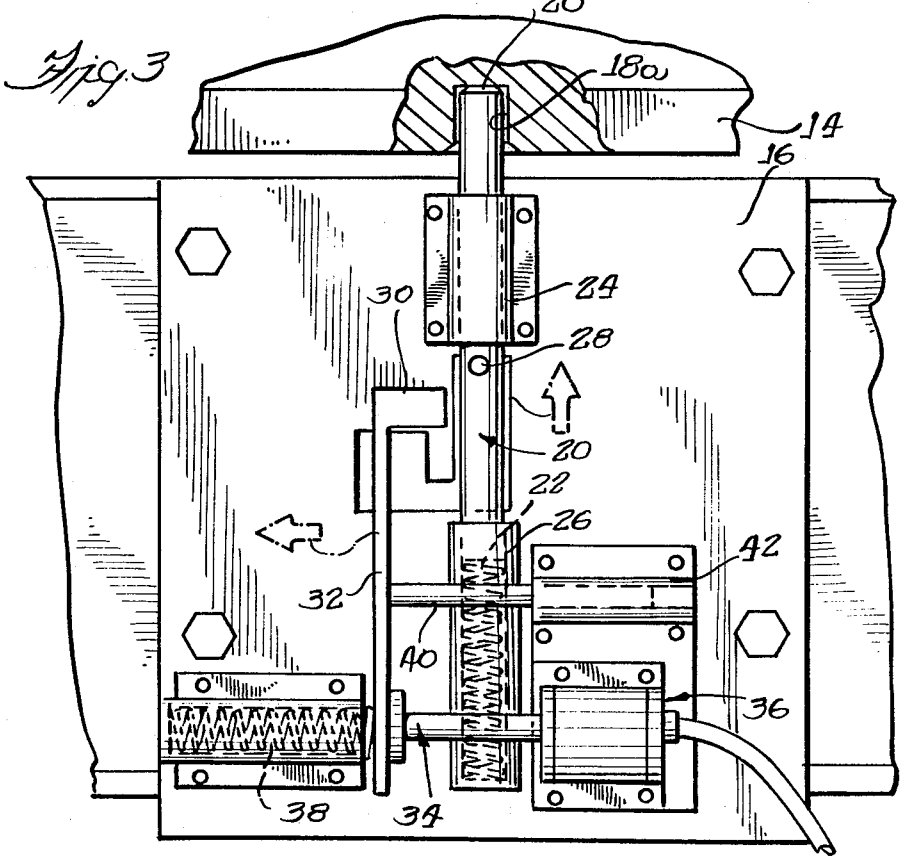
FIG. 3 is a side elevation view similar to FIG. 2, illustrating the elevated, locking position of the bolt.

Referring to FIG. 1, the door locking assembly of the invention, generally designated by reference character 10, is mounted to the frame of a typical railroad boxcar 12 so that the assembly 10 is located below a conventional, sliding door 14. As best shown in FIGS. 2 and 3, the assembly 10 includes a supporting plate 16 mounted on the boxcar frame below the door 14 which has a notch 18 formed in its bottom edge. The assembly 10 includes a vertically oriented, cylindrical lock bolt 20 which is movable in reciprocal motion along its longitudinal axis so that in the locking position shown in FIG. 3 the bolt is displaced upwardly until the upper end **20*a* is inserted within the notch 18 to lock the door 14 against sliding motion to open the door. The bolt 20 is biased into the upward, locking position by a compression spring 22 which bears against the lower end of the bolt. The vertical motion of the bolt 20 and spring 22 are guided by an upper tubular guide 24 and a lower tubular guide 26 which are both mounted on the supporting plate 16. FIGS. 2 and 3 show the interiorly facing surface of the plate 16 on which the components of the assembly 10 including the bolt 20** are mounted to prevent unnecessary exposure.

Figure 4:
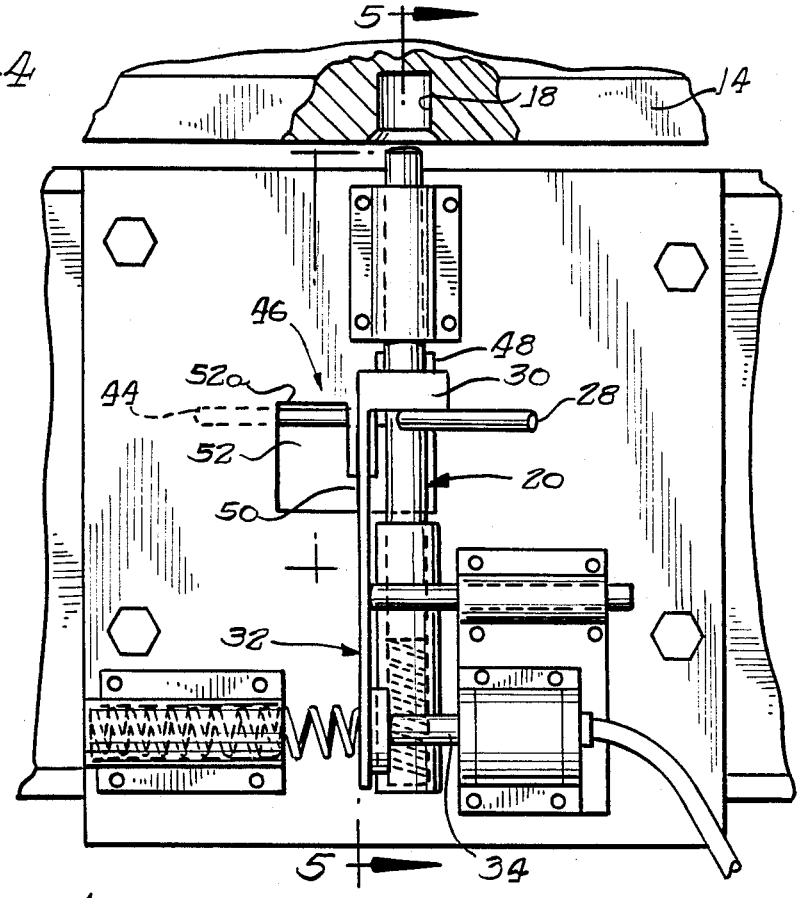
FIG. 4 is a side elevation view similar to FIG. 2, illustrating the locking bolt in a rotated, unlocked position.

Referring again to FIG. 2, the bolt 20 is shown in a lowered position which compresses the spring 22 and retracts the upper end **20*a* from the notch 18 to unlock the door 14 The bolt 20 carries a horizontal catch pin 28 which extends inwardly as particularly shown in FIG. 4. In the unlocked position of the bolt as shown in FIGS. 2 and 4, a movable stop bar 30 is positioned in overlying engagement with the upper surface of the catch pin 28 so that the bar 30 anchors the pin 28 and attached bolt 20 in the lower, unlocked position in opposition to the biasing upward force exerted by the spring 22. The stop bar 30 is oriented generally perpendicular across the pin 28; the bar 30 is supported at the upper end o a vertical catch frame 32. The bottom end of the catch frame 32 is mounted on the projecting end 34*a* of a horizontally reciprocating piston 34 which is driven within a cylinder 36 by fluid pressure, preferably from its own pneumatic system or from a pneumatic branch line communicating with the air brake system typically installed on railroad cars and truck trailers. The cylinder 36 is mounted on the supporting plate 16. A spring 38 within a spring guide 39 bears against the frame 32 and piston 34 for biasing the piston toward its retracted position which maintains the stop bar 30 obstructing the line of reciprocating movement of the latch pin 28; in FIG. 2 the stop bar 30 overlies and holds the latch pin 28 and the attached bolt 20** in the lowered, unlocked position.

In order to elevate the bolt 20 into the upper, locking position shown in FIG. 3, the cylinder 36 is pressurized to drive the piston 34 to the extended position which compresses the spring 38. This extension of the piston 34 horizontally displaces the catch frame 32 and stop bar 30 to the left in the view shown in FIG. 3 so that the stop bar 30 is disengaged from the latch pin 28 which removes the downward restraint thereon and enables decompression of the spring 22 to drive the bolt 20 upwardly into the locking position within the notch 18. Thereafter, the fluid pressure in the cylinder can be released so that the spring 38 again drives the piston 34 to its retracted position resulting in horizontal motion of the catch frame 32 and stop bar 30 which then underlies (not shown) the catch pin 28 and prevents the attached bolt 20 from being lowered, for example by an unauthorized attempt to unlock the door. Added guidance of the horizontal motion of the catch frame 32 is provided by mounting one end of a horizontally projecting, elongate guide member 40 at a generally medial location on the catch frame 32. The other end of the guide member 40 travels through a guide tube 42 mounted on the plate 16.

Figure 5:
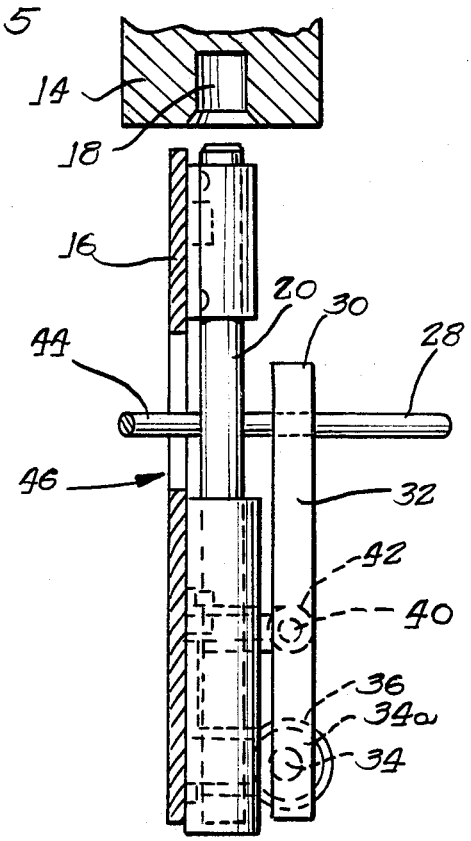
FIG. 5 is a view, in partial section, taken along line 5—5 in FIG. 4 and viewed in the indicated direction.

Referring to FIGS. 4 and 5, the bolt 20 carries a second horizontal projection which is a manual gripping member 44; the gripping member 44 extends outwardly from the bolt 20 and projects through a slot 46 in the plate 16 so that the gripping member 44 is manually accessible on the exterior of the boxcar 12. Since the gripping member 44 must travel in vertical reciprocation with the bolt 20, the slot 46 includes a partitioned, vertical section 48 which provides clearance for the vertical motion of the ripping member 44.

When the boxcar or similarly locked vehicle has reached its destination and it is desired to unlock the door 14, the cylinder 36 is again pressurized to extend the piston against the bias of the spring 38 to the extended position shown in Figs. 3, so that the stop bar 30 is removed from the vertical path of the latch pin 28; thereafter, a workman outside the door 14 can grasp the manual gripping member 44 and push it downwardly overcoming the bias of the spring 22 to lower the bolt 20. The lowering retraction of the bolt end 20*a* from the notch 18 unlocks the door 14 in the lowered position of the bolt 20. At the same time, the workman can rotate the gripping member 44 and the connected bolt 20 to move the gripping member 44 through the horizontal section 50 of the slot 46 until the gripping member 44 reaches the shorter, offset vertical section 52 of the slot 46 as shown in FIG. 4; then the workman can sufficiently reduce the downward pressure he exerts on the gripping member 44 to allow the spring 22 to drive the bolt 20 upwardly a short distance until the upper surface of the gripping member 44 engages the upper edge 52*a* of the slot section 52. The edge 52*a* serves as a stop which bears against the gripping member 44 to restrain it and the connected bolt 20 against further elevation and to prevent reinsertion of the bolt end 20*a* into the notch 18. In this rotated position of the bolt 20, door 14 remains temporarily unlocked so that it can be opened to load or unload freight.

In the unlocked and manually rotated position of the bolt in which the gripping member is restrained by the slot edge 52*a*, the pressure in the cylinder 36 can be released to allow retraction of the piston 34 and catch frame 32 which re-positions the stop bar 30 in its obstructing position (FIG. 4) in order to provide additional assurance that the bolt will be maintained in its lowered position. Thus, even if the gripping member 44 is reverse rotated to re-enter the vertical slot section 48, the stop bar 30 will block sufficient elevation of the catch pin 28 for unintended elevation of the bolt 20 and potential relocking of the door 14.

Once the stop bar has been returned to its blocking position shown in FIG. 4, the workman can deliberately manually reverse rotate the gripping member 44 reentering it into the vertical slot section 48 and returning the catch pin 28 to engagement below the stop bar 30 so that the bolt 20 remains in unlocked position but in a stand-by condition. In this stand-by condition the bolt can be automatically elevated to re-lock the door merely by pressurizing the cylinder 36 and extending the piston 34 to withdraw the stop bar 30 from blocking engagement above the catch pin 28, thus allowing movement of the bolt 20 from the unlocked position shown in FIG. 2 to the locked position shown in FIG. 3. Thereafter, the cylinder pressure can be released to move the stop bar 30 below the catch pin and positively lock the door by obstructing any attempted lowering of the bolt 20.

While a preferred embodiment of the door-locking assembly of the invention is illustrated and described, it is envisioned that those skilled in the art may devise various modifications derived from this description For example, the gripping member can be mounted on the locking bolt at a height different from the catch pin with consequent adjustment in the location of the access slot in the mounting plate. Accordingly, the invention is defined by the spirit and scope of the claims appended hereto, and is not limited by the described embodiment.

The invention is claimed as follows:

1. A door locking assembly for securing the door of a freight transporting compartment or the like comprising: a bolt member movable between a first, door-locking position; a second, door-locking position, and a third, positively restrained door-locking position; and catch means movable separately from said bolt member for selectively and alternatively either blocking or clearing said movement of said bolt member between said first and second positions and between said first and third positions; and positive retaining means for maintaining said third position without manual action.

2. The assembly according to claim 1 further comprising spring means for biasing said bolt member in said first, door-locking position.

3. The assembly according to claim 1 wherein said bolt member comprises an elongate rod and said movement comprises axial reciprocation of said rod between said first and second positions.

4. The assembly according to claim 3 wherein said movement into said third position comprises rotation of said rod about said axial reference of said reciprocation.

5. The assembly according to claim 3 wherein said rod comprises a laterally projecting catch pin for engagement with said catch means.

6. The assembly according to claim 5 wherein said catch means comprises a movable stop member engageable with said catch pin to provide said blocking of said bolt member reciprocation.

7. The assembly according to claim 6 wherein said stop member is engageable below said catch pin to block movement of said bolt from said first position to said second position.

8. The assembly according to claim 6 wherein said stop member is engageable above said catch pin to block movement of said bolt from said second position to said first position.

9. The assembly according to claim 6 wherein said stop member is biased for normal position obstructing movement of said catch pin and said bolt member reciprocation.

10. The assembly according to claim 6 wherein said catch means further comprises drive means for displacing said stop member from said obstructing position to a clearing position enabling said bolt member movement.

11. The assembly according to claim 10 wherein said stop member is mounted on a movable, supporting catch frame biased to locate said stop member in said obstructing position, and wherein said drive means comprises a fluid actuated reciprocating piston for selective displacement of said frame to move said stop member into said clearing position.

12. The assembly according to claim 1 wherein said bolt member comprises a gripping member for enabling manual movement of said bolt member into said third position.

13. The assembly according to claim 12 wherein said gripping member comprises a gripping pin laterally projecting from said bolt member.

14. The assembly according to claim 13 wherein said bolt member is rotatable about a longitudinal axis thereof for rotation of said bolt member into said third position.

15. The assembly according to claim 12 wherein said retaining means engageable with said gripping member for retaining said bolt member in said third position.

16. The assembly according to claim 15 wherein said retaining means comprises a plate having an aperture through which said gripping member projects in said third position.

17. The assembly according to claim 16 wherein said aperture comprises at least first and second partitioned portions thereof through which said gripping means alternatively projects in said respective second and third positions of said bolt member.

18. The assembly according to claim 17 wherein said partitioned portions of said aperture are joined by a passageway portion thereof through which said gripping means is selectively moveable between said partitioned portions.

19. The assembly according to claim 16 wherein said assembly is supported on said plate.

20. The assembly according to claim 1 wherein said catch means provides clearance for said movement between said second and third position.

21. The assembly according to claim 1 further comprising remotely actuated drive means enabling displacement of said movable catch means from a blocking position obstructing movement of said bolt member to a clearing position allowing movement of said bolt member into said first, door-locking position under force imposed by means for biasing said bolt member into said first position.

22. The assembly according to claim 1 wherein the same position of said movable catch means obstructs both removal of said bolt member from said first, door-locking position and also obstructs entry of said bolt member into any door-locking position.

* * * * *